United States Patent [19]

Burgdorf et al.

[11] Patent Number: 4,898,296

[45] Date of Patent: Feb. 6, 1990

[54] BUNGED VESSEL

[75] Inventors: Märten Burgdorf, Heimerzheim; Wilhelm Kühne, Wiesenbach; Udo-Hermann Maus, Bammental, all of Fed. Rep. of Germany

[73] Assignee: Mauser-Werker GmbH, Bruhl, Fed. Rep. of Germany

[21] Appl. No.: 178,678

[22] Filed: Apr. 7, 1988

[51] Int. Cl.[4] ..... B65D 1/20

[52] U.S. Cl. ..... 220/72; 220/288; 220/DIG. 1; 220/DIG. 6; 222/572

[58] Field of Search ..... 220/465, 288, 5 R, DIG. 1, 220/DIG. 6, 72, 74; 222/566, 572

[56] References Cited

U.S. PATENT DOCUMENTS

| | | | |
|---|---|---|---|
| 1,178,717 | 4/1916 | Hackney | 220/DIG. 1 |
| 3,468,450 | 9/1969 | Webel | 220/72 |
| 4,033,473 | 7/1977 | Raley | 220/74 |
| 4,094,432 | 6/1978 | Zilbert | 220/688 |
| 4,228,911 | 10/1980 | Hammes | 220/74 |
| 4,640,446 | 2/1987 | Walker | 220/855 P |
| 4,674,648 | 6/1987 | Przytulla | 220/72 |

FOREIGN PATENT DOCUMENTS

| | | | |
|---|---|---|---|
| 359229 | 10/1931 | United Kingdom | 222/572 |
| 669594 | 4/1952 | United Kingdom | 220/5 R. |

*Primary Examiner*—George E. Lowrance
*Attorney, Agent, or Firm*—Pennie & Edmonds

[57] ABSTRACT

The invention relates to a bunged vessel of thermoplastic synthetic material having bungs arranged in the head end area. At least one of the bungs is arranged laterally outwardly of the center of the head end with the interior wall surface thereof generally flush with the interior wall surface of the cylindrical part of the shell of the vessel.

4 Claims, 1 Drawing Sheet

BUNGED VESSEL

BACKGROUND OF THE INVENTION

The invention relates to an improved bunged vessel of thermoplastic synthetic material having carriage and transport rings formed in one piece with the shell of the vessel. The rings are arranged in the region of the head and bottom ends of the vessel and have horizontal and vertical bearing surfaces for the arms of a vessel lifter to be used. In conventional vessels of this kind where bungs are arranged in the head end area, there is a problem of draining residues. This is especially significant in vessels intended as multipurpose packaging. The known arrangement of the bungs in the head end area of the vessel leaves pockets that preclude total emptying of the vessel of its contents, owing to recesses in the configuration of the vessel.

SUMMARY OF THE INVENTION

The invention provides for the possibility of total emptying of the vessel by pouring the contents through an improved bunged construction. This object is accomplished, according to the invention, in that at least one of the bungs in the head end is offset laterally outwardly toward the periphery of the head end with the interior wall surface thereof generally flush with the interior wall surface of the cylindrical portion of the shell of the vessel.

In such a bung arrangement, no step is left between the bung hole and the interior wall surface of the shell of the vessel at the head end area. More particularly, at the outward terminal end of a common diameter of the bung hole and shell, the wall surfaces are flush so that no residue can remain in the vessel when a vessel is emptied through this bung hole.

As one example of the invention, the bung may be directed into the interior of the vessel with the interior surface of the shell of the vessel bounding the bung hole. In this case, the bung will have an internal thread. In another example, the bung can extend upwardly from the head end of the vessel and be externally threaded for attachment of a bung closure. Also, to permit either internal or external threading of the bung and thereby use of a stopper or a cap onto the bung as the case may be, the bung may rise upwardly from the head end area of the vessel.

Since the fill and discharge bungs customarily lie in the seam region of a blown vessel, there is an additional accumulation of material at these bungs due to the forming action of the tools in the manufacturing operation. In this regard, reference is made to U.S. Pat. Nos. 4,228,122 and 4,378,328. Thus, an adequate outward displacement of one of these bungs to obtain alignment with the interior wall surface of the cylindrical portions of the shell may involve difficulties. Therefore, according to the preferred embodiment of the invention, a third residue drain nozzle or bung may be provided and circumferentially offset 90° from the fill and drain bungs. The drain bung will thereby be formed in the area of the thinner wall section of the vessel. At this location, alignment and flushness of its interior wall surface with the inner wall surface of the cylindrical portion of the shell is readily obtainable.

DETAILED DESCRIPTION OF THE INVENTION

Figure 5:
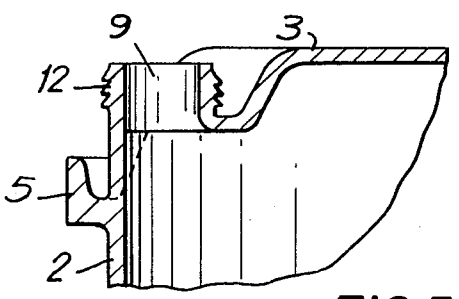
FIG. 5 is an enlarged cross-sectional view similar to FIG. 3 of another embodiment of the invention showing a bung with screw fitting directed outwardly of the vessel.

The bunged vessel 1 includes a shell having a generally cylindrical portion 2 extending between head and bottom ends 3 and 4, respectively. Carriage and transport rings 5, 6 are formed at the head and bottom end. Each ring consists of a vertical and a horizontal annular web, forming the bearing surfaces for the arms of a vessel lifter to be used.

The head end 3 of the vessel 1 includes a fill and discharge bung 7 and a vent bung 8. In this embodiment by way of example, an additional residue drain bung 9 is provided in the head end area 3. All bungs lie within pockets 10 and terminate, for reasons of stacking, below the surface of the head end 3. The residue drain bung 9 is arranged offset 90° from the fill and vent bungs 7, 8 and is consequently located outside of the seam areas of thickened wall dimension.

The following details of configuration of the discharge bung 9 may apply also, with suitable conformation, to either of the bungs 7 and 8. In that case, the bung in question will assume the additional function of residue drain, so that the bung 9 may be dispensed with.

Figure 3:
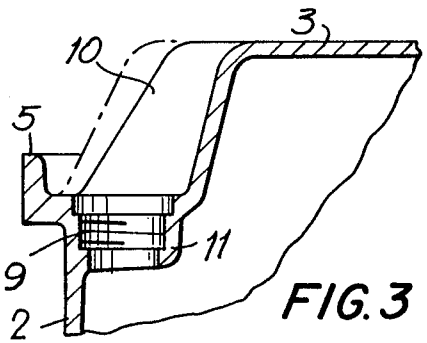
FIG. 3 is an enlarged cross-sectional view taken along line 3—3 of FIG. 2 showing a bung with screw fitting directed inwardly of the vessel.
Figure 4:
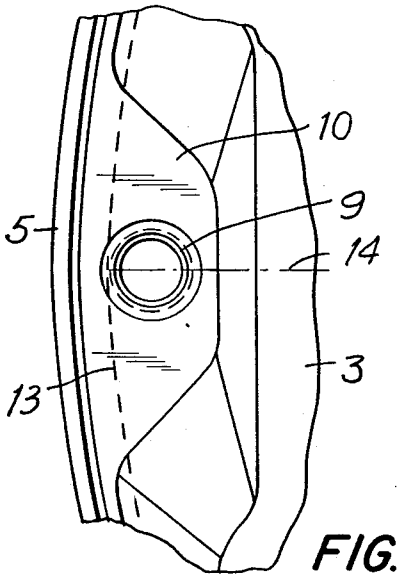
FIG. 4 shows a top view of a fragment of FIG. 3.
Figure 1:
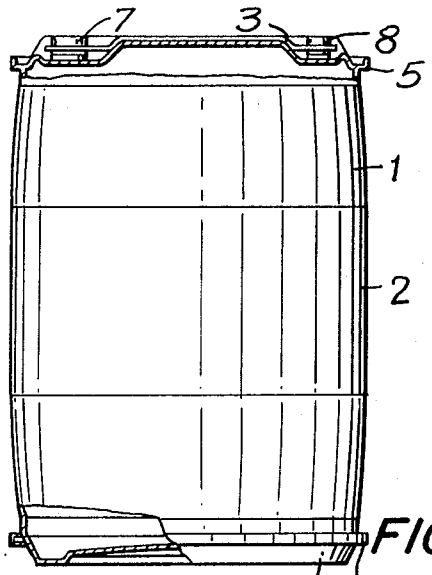
FIG. 1 shows a bunged vessel of thermoplastic synthetic material in partial section.
Figure 2:
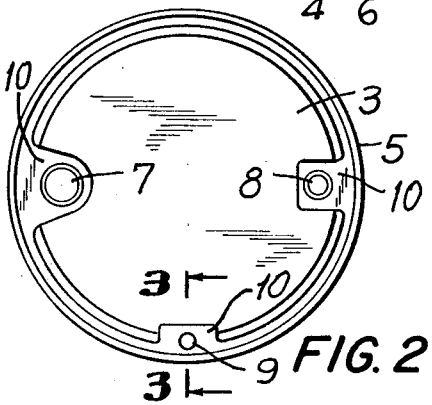
FIG. 2 shows a top view of FIG. 1.

In FIGS. 3 and 4, the residue drain bung 9 arranged in the bottom of the bung trough 10 has its screw fitting portion 11 pointing into the interior of the vessel. This bung 9 is arranged offset outwardly toward the periphery of the head end 3 so that its interior wall surface is in part flush with the interior wall surface of the cylindrical portion 2 of the shell of the vessel 1. In the top view of FIG. 4, the arc bounding the interior wall surface of the hole of the residue drain bung 9 and the dashed arc 13 bounding the interior wall surface of the cylindrical portion 2 of the shell of the vessel 1 are tangent to each other. This tangency exists at the outward terminal end of the common diameter of the bung hole, defined by the bung 9, and the cylindrical portion 2 of the shell. This common diameter is shown at 14 in FIG. 4. The inwardly directed screw fitting 11 has an internal thread to accept a stopper not shown in the drawing.

Figure 6:
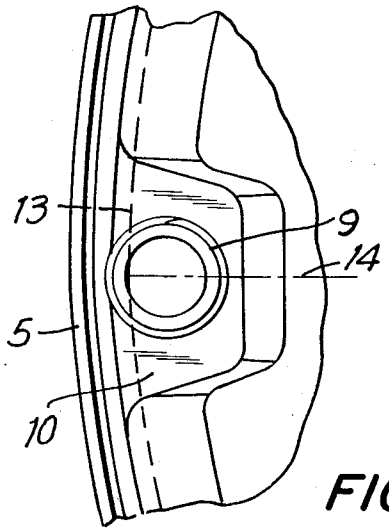
FIG. 6 shows a top view of a fragment of FIG. 5.

In the embodiment seen in FIG. 5, the screw fitting 12 of the residue drain bung 9 rises upwardly from the head end 3 of the vessel 1. In this embodiment, an external thread may be provided to accept a cap. Naturally, an internal thread to accept a stopper may be provided as well. The top view in FIG. 6 is similar to FIG. 4 and shows the tangency of the bung hole and cylindrical shell. As will be seen in FIG. 6, the common diameter is shown at 14.

We claim:

1. In a bunged vessel of thermoplastic material having a shell, head and bottom ends and transport rings formed in one piece with the shell and arranged in the region of the head and bottom ends, the shell having a generally cylindrically shaped portion extending between the ends of the vessel and one of the transport rings being disposed at the juncture of the shell and head end and extending around the shell and having a first portion extending radially outwardly of the cylindrically shaped portion of the shell and a second vertically extending portion at the radial outer end of the first portion, and bungs disposed below the uppermost surface of the head end and defining bung holes disposed in the head end, the improvement characterized in that at least one of the bungs is disposed laterally outwardly of the head end with the interior and exterior wall surfaces thereof flush with the interior and exterior wall surfaces of the cylindrical portion of the shell of the vessel at the laterally outward end of a common diameter of the bung hole and cylindrical portion of the vessel and in that said at least one bung is threaded, and any wall surface of the cylindrical shell part of the vessel or extension thereof bounding the bung is also threaded.

2. A bunged vessel according to claim 1, characterized in that the internal wall surface of said at least one bung is threaded and directed into the interior of the vessel with the interior wall surface of the cylindrical shell part of the vessel bounding the bung hole being threaded.

3. A bunged vessel according to claim 1, characterized in that said at least one bung extends upwardly from the head end of the vessel.

4. A bunged vessel according to any one of claims 1–3, characterized in that said vessel is formed with:

(a) thickened wall sections at diametrically opposite sides thereof;

(b) fill and drain bungs disposed at said diametrically opposite sides;

(c) a drain bung offset circumferentially by about 90° from said fill and drain bungs; and (d) with said drain bung having its interior wall surface generally flush with the interior wall surface of the cylindrical portion of the shell of the vessel.

* * * * *